US007057559B2

(12) United States Patent
Werner et al.

(10) Patent No.: US 7,057,559 B2
(45) Date of Patent: Jun. 6, 2006

(54) FRACTILE ANTENNA ARRAYS AND METHODS FOR PRODUCING A FRACTILE ANTENNA ARRAY

(75) Inventors: Douglas H. Werner, State College, PA (US); Waroth Kuhirun, Bangkok (TH); Pingjuan L. Werner, State College, PA (US)

(73) Assignee: Penn State Research Foundation, University Park, PA (US)

( * ) Notice: Subject to any disclaimer, the term of this patent is extended or adjusted under 35 U.S.C. 154(b) by 80 days.

(21) Appl. No.: 10/625,158

(22) Filed: Jul. 23, 2003

(65) Prior Publication Data

US 2004/0135727 A1 Jul. 15, 2004

Related U.S. Application Data

(60) Provisional application No. 60/398,301, filed on Jul. 23, 2002.

(51) Int. Cl.
*H01Q 1/38* (2006.01)

(52) U.S. Cl. ..... 343/700 MS; 343/792.5; 343/702

(58) Field of Classification Search ..... 343/702, 343/792.5, 741, 742, 804, 806, 700 MS
See application file for complete search history.

(56) References Cited

U.S. PATENT DOCUMENTS 6,452,553 B1 * 9/2002 Cohen ..... 343/702
6,525,691 B1 2/2003 Varadan et al. ..... 343/700 MS
2003/0034918 A1 * 2/2003 Werner et al. ..... 343/700 MS

OTHER PUBLICATIONS

Werner, "An Array of Possibilities," [retrieved on Jul. 11, 2003], retrieved from the Internet <URL:http://www.engr.psu.edu/news/Publications/EPSsum00/HTML_files/array.html>.

ANON, "Fractal Tiling Arrays—Firm Reports Breakthrough In Array Antennas"[online], [retrieved on Jul. 15, 2003], retrieved from the Internet <URL:http://www.fractenna.com/nca_news_08.html>.

* cited by examiner

*Primary Examiner*—Hoanganh Le
*Assistant Examiner*—Ephrem Alemu
(74) *Attorney, Agent, or Firm*—Morgan, Lewis & Bockius LLP

(57) ABSTRACT

An antenna array comprised of a fractile array having a plurality of antenna elements uniformly distributed along a Peano-Gosper curve. An antenna array comprised of an array having an irregular boundary contour comprising a plane tiled by a plurality of fractiles covering the plane without any gaps or overlaps. A method for generating an antenna array having improved broadband performance wherein a plane is tiled with a plurality of non-uniform shaped unit cells or an antenna array, the non-uniform shaped and tiling of the unit cells are then optimized. A method for rapidly forming a radiation pattern of a fractile array employing a pattern multiplication for fractile arrays wherein a product formulation is derived for the radiation pattern of a fractile array for a desired stage of growth. The pattern multiplication is recursively applied to construct higher order fractile array forming an antenna array.

6 Claims, 14 Drawing Sheets

FRACTILE ANTENNA ARRAYS AND METHODS FOR PRODUCING A FRACTILE ANTENNA ARRAY

This application claims the benefit of Provisional Application No. 60/398,301, filed Jul. 23, 2002.

FIELD OF THE INVENTION

The present invention is directed to fractile antenna arrays and a method of producing a fractile antenna array with improved broadband performance. The present invention is also directed to methods for rapidly forming a radiation pattern of a fractile array.

BACKGROUND OF THE INVENTION

Fractal concepts were first introduced for use in antenna array theory by Kim and Jaggard. See, Y. Kim et al., "*The Fractal Random Array*," Proc. IEEE, Vol. 74, No. 9, pp. 1278–1280, 1986. A design methodology was developed for quasi-random arrays based on properties of random fractals. In other words, random fractals were used to generate array configurations that are somewhere between completely ordered (i.e., periodic) and completely disordered (i.e., random). The main advantage of this technique is that it yields sparse arrays that possess relatively low sidelobes (a feature typically associated with periodic arrays but not random arrays) which are also robust (a feature typically associated with random arrays but not periodic arrays). More recently, the fact that deterministic fractal arrays can be generated recursively (i.e., via successive stages of growth starting from a simple generating array) has been exploited to develop rapid algorithms for use in efficient radiation pattern computations and adaptive beamforming, especially for arrays with multiple stages of growth that contain a relatively large number of elements. See, D. H. Werner et. al., "*Fractal Antenna Engineering: The Theory and Design of Fractal Antenna Arrays*," IEEE Antennas and Propagation Magazine, Vol. 41, No. 5, pp. 37–59, October 1999. It was also demonstrated that fractal arrays generated in this recursive fashion are examples of deterministically thinned arrays. A more comprehensive overview of these and other topics related to the theory and design of fractal arrays may be found in D. H. Werner and R. Mittra, *Frontiers in Electromagnetics* (IEEE Press, 2000).

Techniques based on simulated annealing and genetic algorithms have been investigated for optimization of thinned arrays. See, D. J. O'Neill, "*Element Placement in Thinned Arrays Using Genetic Algorithms*," OCEANS '94, Oceans Engineering for Today's Technology and Tomorrows Preservation, Conference Proceedings, Vol. 2, pp. 301–306, 199; G. P. Junker et al., "*Genetic Algorithm Optimization of Antenna Arrays with Variable Interelement Spacings,*" 1998 IEEE Antennas and Propagation Society International Symposium, AP-S Digest, Vol. 1, pp. 50–53, 1998; C. A. Meijer, "*Simulated Annealing in the Design of Thinned Arrays Having Low Sidelobe Levels*," COMSIG'98, Proceedings of the 1998 South African Symposium on Communications and Signal Processing, pp. 361–366, 1998; A. Trucco et al., "*Stochastic Optimization of Linear Sparse Arrays*," IEEE Journal of Oceanic Engineering, Vol. 24, No. 3, pp. 291–299, July 1999; R. L. Haupt, "*Thinned Arrays Using Genetic Algorithms*," IEEE Trans. Antennas Propagat., Vol. 42, No. 7, pp. 993–999, July 1994. A typical scenario involves optimizing an array configuration to yield the lowest possible side lobe levels by starting with a fully populated uniformly spaced array and either removing certain elements or perturbing the existing element locations. Genetic algorithm techniques have been developed for evolving thinned aperiodic phased arrays with reduced grating lobes when steered over large scan angles. See, M. G. Bray et al., "*Thinned Aperiodic Linear Phased Array Optimization for Reduced Grating Lobes During Scanning with Input Impedance Bounds*, "Proceedings of the 2001 IEEE Antennas and Propagation Society International Symposium, Boston, Mass., Vol. 3, pp. 688–691, July 2001; M. G. Bray et al.," *Matching Network Design Using Genetic Algorithms for Impedance Constrained Thinned Arrays*," Proceedings of the 2002 IEEE Antennas and Propagation Society International Symposium, San Antonio, Tex., Vol. 1, pp. 528–531, June 2001; M. G. Bray et al., "*Optimization of Thinned Aperiodic Linear Phased Arrays Using Genetic Algorithms to Reduce Grating Lobes During Scanning*," IEEE Transactions on Antennas and Propagation, Vol. 50, No. 12, pp. 1732–1742, December 2002. The optimization procedures have proven to be extremely versatile and robust design tools. However, one of the main drawbacks in these cases is that the design process is not based on simple deterministic design rules and leads to arrays with non-uniformly spaced elements.

SUMMARY OF THE INVENTION

The present invention is directed to an antenna array, comprised of a fractile array having a plurality of antenna elements uniformly distributed along Peano-Gosper curve.

The present invention is also directed to an antenna array comprised of an array having an irregular boundary contour. The irregular boundary contour comprises a plane tiled by a plurality of fractiles and the plurality of fractiles covers the plane without any gaps or overlaps.

The present invention is also directed to a method for generating an antenna array having improved broadband performance. A plane is tiled with a plurality of non-uniform shaped unit cells of an antenna array. The non-uniform shape of the unit cells and the tiling of said unit cells are then optimized.

The present invention is also directed to a method for rapidly forming a radiation pattern of a fractile array. A pattern multiplication for fractile arrays is employed wherein a product formulation is derived for the radiation pattern of a fractile array for a desired stage of growth. The pattern multiplication for the fractile arrays is recursively applied to construct higher order fractile arrays. An antenna array is then formed based on the results of the recursive procedure.

The present invention is also directed to a method for rapidly forming a radiation pattern of a Peano-Gosper fractile array. A pattern multiplication for fractile arrays is employed wherein a product formulation is derived for the radiation pattern of a fractile array for a desired stage of growth. The pattern multiplication for the fractile arrays is recursively applied to construct higher order fractile arrays. An antenna array is formed based on the results of the recursive procedure.

BRIEF DESCRIPTION OF THE DRAWINGS

The accompanying drawings, which are included to provide further understanding of the invention and are incorporated in and constitute part of this specification, illustrate embodiments of the invention and, together with the description, serve to explain the principles of the invention.

In the drawings.

DETAILED DESCRIPTION OF PREFERRED EMBODIMENTS

Figure 1A:
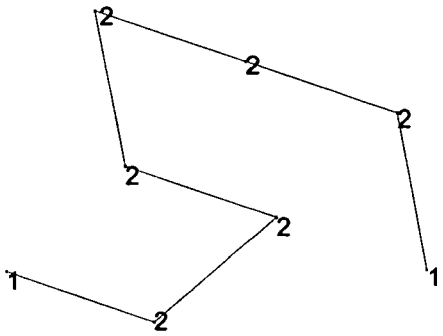
FIGS. 1A–1C illustrate element locations and associated current distribution for stage 1, stage 2 and state 3 Peano-Gosper fractile arrays.
Figure 1B:
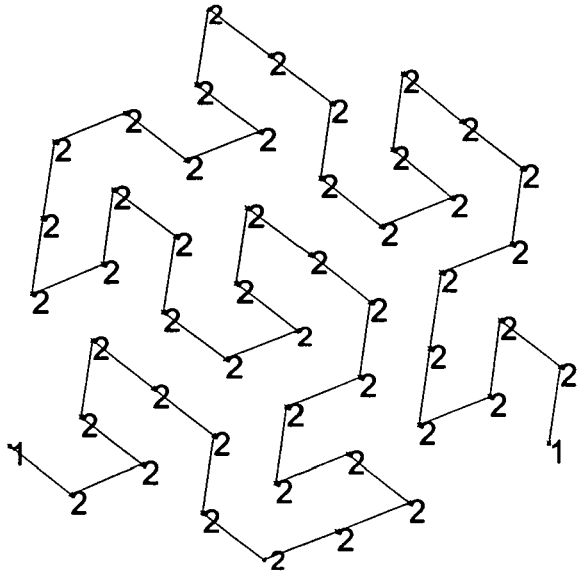
Figure 1C:
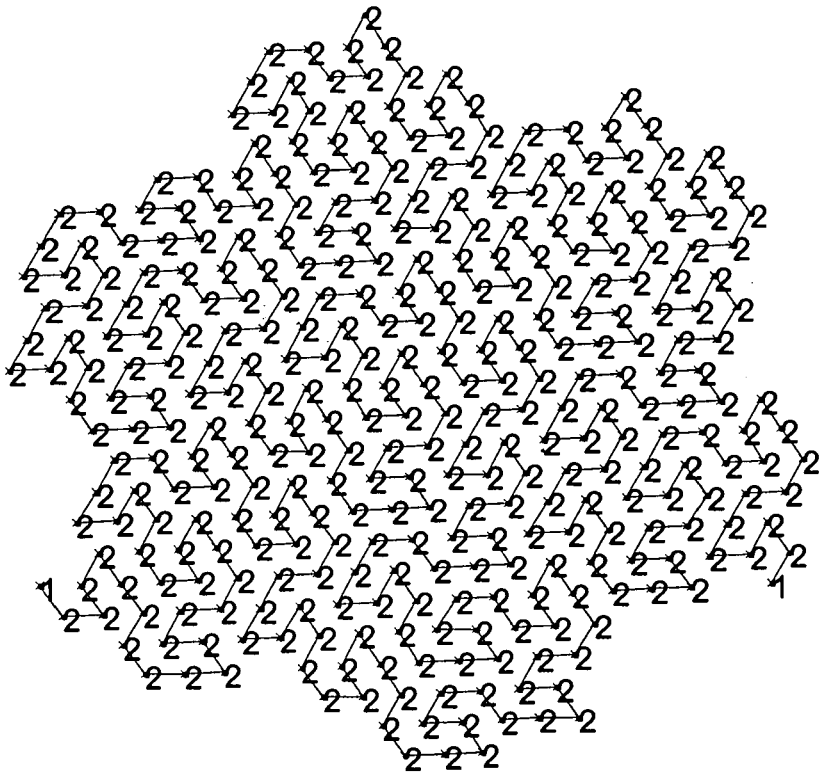

FIGS. 1A–1C illustrate the antenna element locations and associated current amplitude excitations for a stage 1, stage 2 and stage 3 Peano-Gosper fracticle arrays where the antenna elements are distributed over a planar area (e.g., in free-space, over a geographical area, mounted on an Electromagnetic Band Gap (EBG) surface or an Artificial Magnetic Conducting (AMC) ground plane, mounted on an aircraft, mounted on a ship, mounted on a vehicle, etc.) A fractile array is defined as an array with a fractal boundary contour that tiles the plane without leaving any gaps or without overlapping, wherein the fractile array illustrates improved broadband characteristics. The numbers 1 and 2 denote each antenna element's relative current amplitude excitation. The minimum spacing between antenna elements is assumed to be held fixed at a value of $d_{min}$ for each stage of growth. The antenna elements may be comprised of shapes and sizes of elements well know to those skilled in the art. Some examples of potential applications for this type of array are listed in Table 1.

TABLE 1

| Application | Frequency (GHz) | Wavelength (cm) | $d_{min}$ (cm) |
|---|---|---|---|
| Broadband L - Band Array | 1–2 | 30–15 | 15 |
| Broadband S - Band Array | 2–4 | 15–7.5 | 7.5 |
| Broadband L-Band & S-Band Array | 1–4 | 30–7.5 | 7.5 |
| Broadband C - Band Array | 4–8 | 7.5–3.75 | 3.75 |
| Broadband S-Band & C-Band Array | 2–8 | 15–3.75 | 3.75 |
| Broadband X - Band Array | 8–12 | 3.75–2.5 | 2.5 |
| Broadband C-Band & X-Band Array | 4–16 | 7.5–1.875 | 1.875 |
| Broadband $K_u$ - Band Array | 12–18 | 2.5–1.667 | 1.667 |
| Broadband K - Band Array | 18–27 | 1.667–1.111 | 1.111 |
| Broadband $K_a$ - Band Array | 27–40 | 1.111–0.75 | 0.75 |
| Broadband $K_u$-, K-, & $K_a$- Band Array | 12–48 | 2.5–0.625 | 0.625 |
| Broadband Millimeter Wave Array | 40–160 | 0.75–0.1875 | 0.1875 |

Figure 2A:
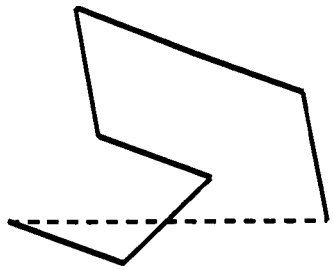
FIGS. 2A–2C illustrate the first three stages in the construction of a self-avoiding Peano-Gosper curve.
Figure 2B:
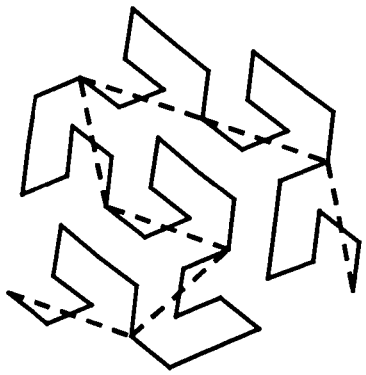
Figure 2C:
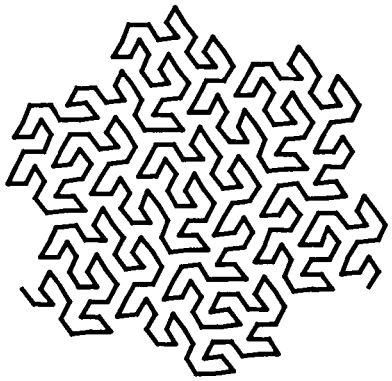
Figure 3A:
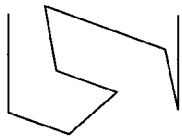
FIGS. 3A–3C illustrate Gosper islands and their corresponding Peano-Gosper curves for (a) stage 1, (b) stage 2, and (c) stage 4.
Figure 3B:
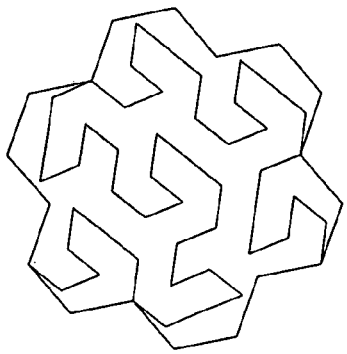
Figure 3C:
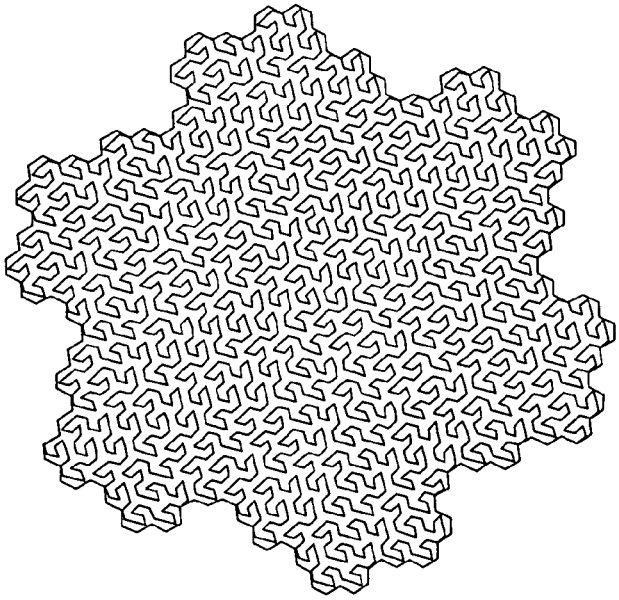

Referring to FIGS. 2A–2C, the first three stages in the construction of a Peano-Gosper curve are illustrated. The generator at stage P=1, FIG. 2A, is first scaled by the appropriate expansion factor δ to obtain the stage P=2 (FIG. 2B) construction of the Peano-Gosper curve. The expansion factor δ is defined in equation 13, below, for a Peano-Gosper array. The next step in the construction process is to then replace each of the seven segments of the scaled generator by an exact copy of the original generator translated and rotated as shown in FIG. 2B. This iterative process may be repeated to generate Peano-Gosper curves up to an arbitrary stage of growth P. FIGS. 3A–3C show stage 1, stage 2, and stage 4 Gosper islands bounding the associated Peano-Gosper curves which fill the interior.

Higher-order Peano-Gosper fractile arrays (i.e., arrays with P>1) are recursively constructed using a formula for copying, scaling, rotating, and translating of the generating array defined at stage 1 (P=1). Equations 1–14, below, are used for this recursive construction procedure. FIGS. 1A–1C illustrate a graphical representation of the procedure. The array factor (i.e., radiation pattern) for a stage P Peano-Gosper fractile array is expressed in terms of the product of P 3×3 matrices which are pre-multiplied by a vector A and post-multiplied by a vector C.

$$AF_P(\theta,\phi)=AB_PC \tag{1}$$

where $$A=[a_1\ a_2\ a_3] \tag{2}$$

$$a_i = 2\cos\left[\frac{kd_{\min}}{2}\sin\theta\cos(\varphi-\varphi_i+(P-1)\alpha)\right] \tag{3}$$

$$\varphi_i = (i-1)\frac{2\pi}{3} \tag{4}$$

$$C = \begin{bmatrix} 1 \\ 0 \\ 0 \end{bmatrix} \tag{5}$$

-continued $$B_P = \prod_{p=1}^{P} F_p = B_{P-1} F_P \tag{6}$$

$$F_p = [f_{ij}^p]_{(3\times 3)} \tag{7}$$

$$f_{ij}^p = \sum_{n \in N_{ij}} \exp j[k r_{np} \sin\theta \cos[\varphi - \varphi_j - \gamma_n + (P - p + 1)\alpha]] \tag{8}$$

$$r_{np} = \delta^{p-1}\sqrt{x_n^2 + y_n^2} \tag{9}$$

$$\gamma_n = \begin{cases} \arctan\left(\frac{y_n}{x_n}\right), & x_n > 0 \\ 0, & x_n = 0 \\ \arctan\left(\frac{y_n}{x_n}\right) + \pi, & x_n < 0 \end{cases} \tag{10}$$

$$\varphi_j = (j-1)\frac{2\pi}{3} \tag{11}$$

$$\alpha = \arctan\left(\frac{\sqrt{3}}{5}\right) \tag{12}$$

$$\delta = \frac{\sqrt{3}}{2}\frac{1}{\sin\alpha} \tag{13}$$

$$k = \frac{2\pi}{\lambda} \tag{14}$$

where λ is the free-space wavelength of the electromagnetic radiation produced by the fractile array. The selection of constants and coefficients are within the ordinary skill of the art. The values of $N_{ij}$ required in (8) are found from $$N = [N_{ij}]_{-} = \begin{bmatrix} \{1,3,5,6\} & \{2\} & \{4,7\} \\ \{4,7\} & \{1,3,5,6\} & \{2\} \\ \{2\} & \{4,7\} & \{1,3,5,6\} \end{bmatrix} \tag{15}$$

Expressions for $(x_n, y_n)$ in terms of the array parameters $d_{min}$, α, and δ for n=1–7 are listed in Table 2.

TABLE 2

| n | $x_n$ | $y_n$ |
|---|---|---|
| 1 | $0.5d_{min}(\cos\alpha - \delta)$ | $-0.5d_{min}\sin\alpha$ |
| 2 | 0 | 0 |
| 3 | $d_{min}(0.5\delta - 1.5\cos\alpha)$ | $1.5d_{min}\sin\alpha$ |
| 4 | $d_{min}(0.5\delta - 2\cos\alpha - 0.5\cos(\pi/3 + \alpha))$ | $d_{min}(0.5\sin(\pi/3 + \alpha) + 2\sin\alpha)$ |
| 5 | $d_{min}(0.5\delta - 1.5\cos\alpha - \cos(\pi/3 + \alpha))$ | $d_{min}(\sin(\pi/3 + \alpha) + 1.5\sin\alpha)$ |
| 6 | $d_{min}(0.5\delta - 0.5\cos\alpha - \cos(\pi/3 + \alpha))$ | $d_{min}(\sin(\pi/3 + \alpha) + 0.5\sin\alpha)$ |
| 7 | $d_{min}(0.5\delta - 0.5\cos(\pi/3 + \alpha))$ | $0.5d_{min}\sin(\pi/3 + \alpha)$ |

Figure 4:
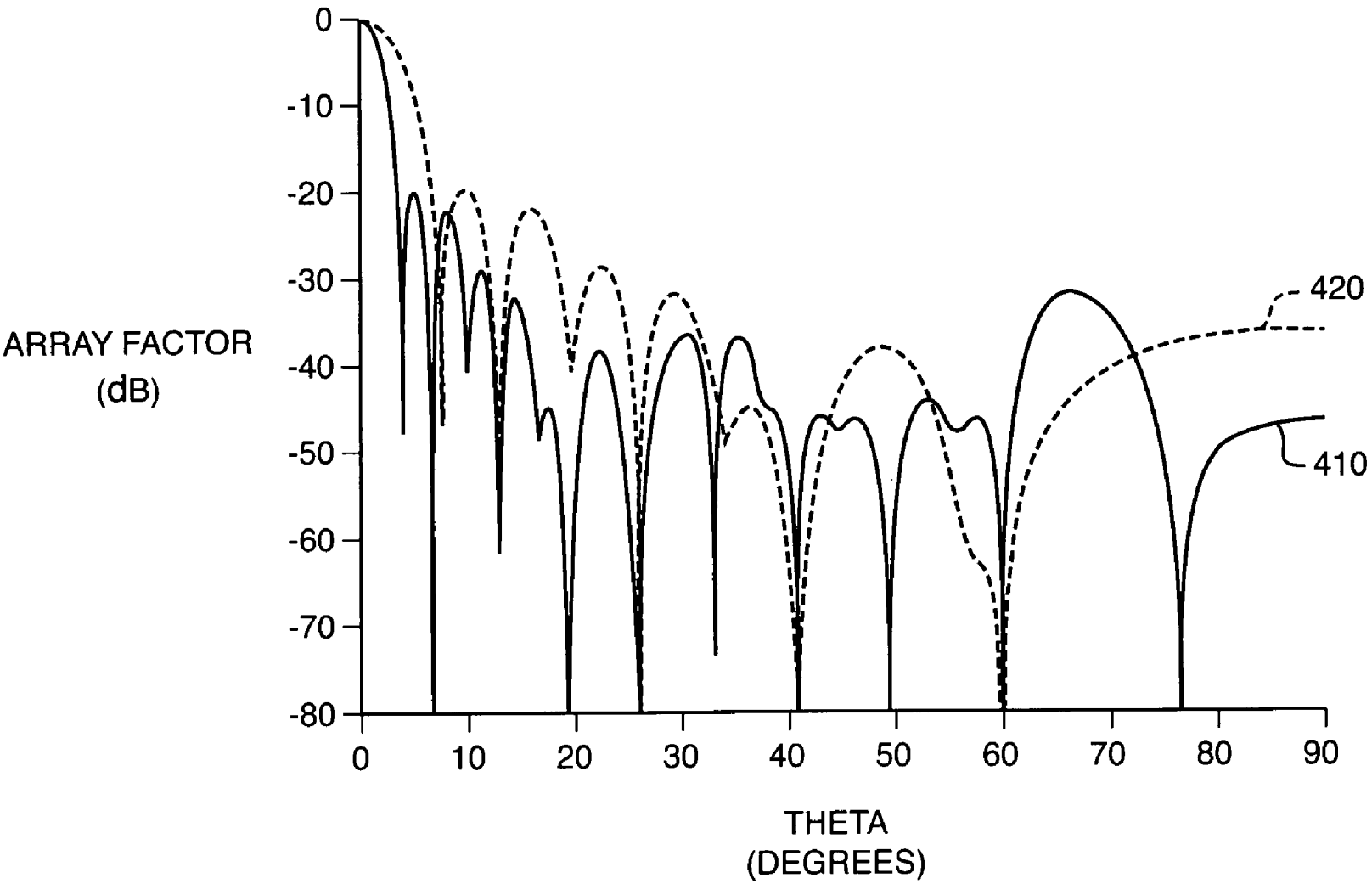
FIG. 4 illustrates a plot of the normalized stage 3 Peano-Gosper fractile array factor versus for θ for $\phi=0°$.
Figure 5:
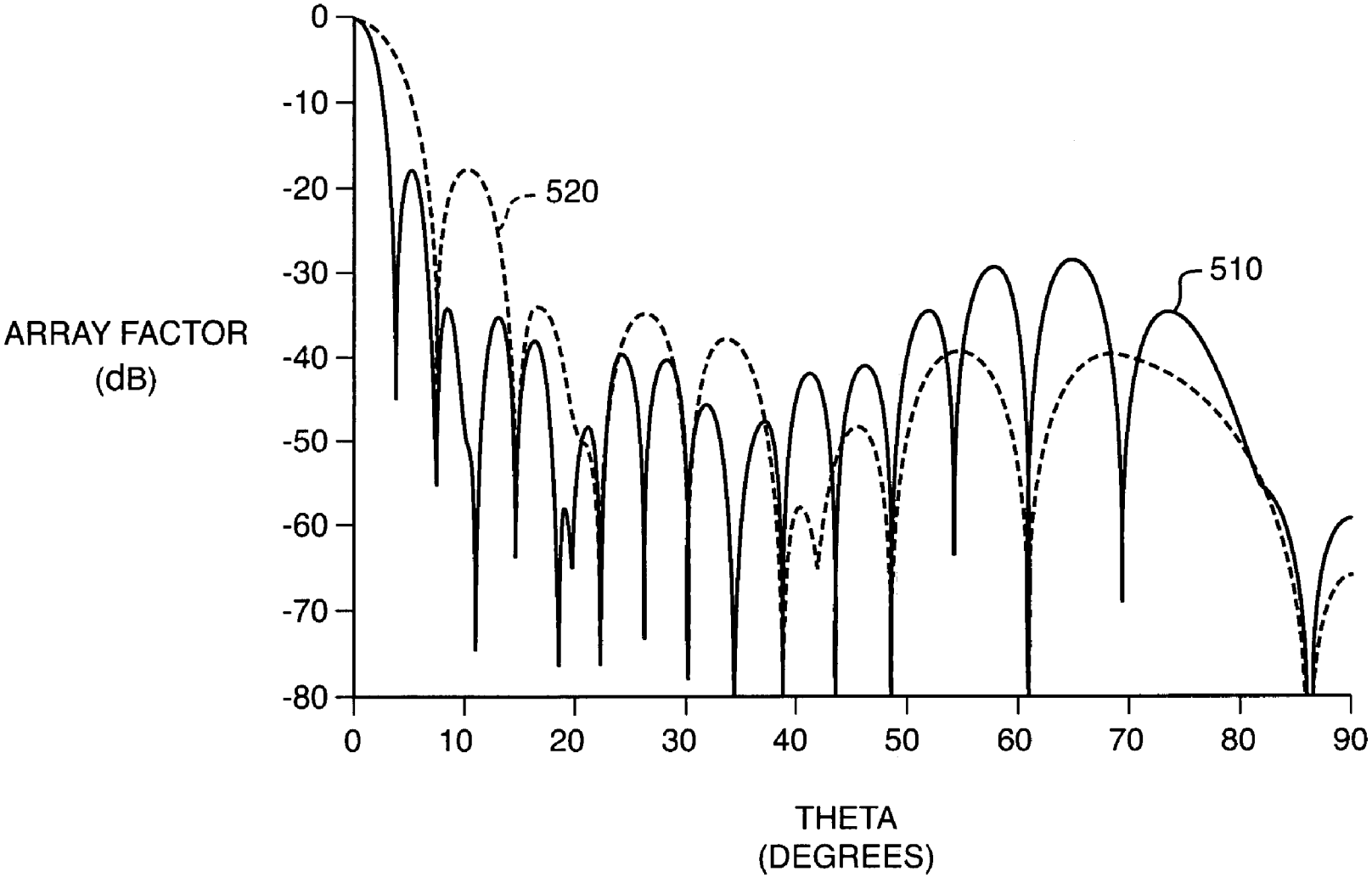
FIG. 5 illustrates a plot of the normalized stage 3 Peano-Gosper fractile array factor versus θ for $\phi=90°$.

With reference to FIG. 4, a plot of the normalized array factor versus θ for a stage 3 Peano-Gosper fractile array with ϕ=0° is illustrated. Curve 410 represents the corresponding radiation pattern slices for the Peano-Gosper array with element spacings of $d_{min}=\lambda$. Curve 420 represents radiation pattern slices for a Peano-Gosper array with element spacings of $d_{min}=\lambda/2$. Likewise with reference to FIG. 5, a plot of the normalized array factor versus θ for a stage 3 Peano-Gosper fractile array with ϕ=90° is illustrated. Curve 510 represents the corresponding radiation pattern slices for the Peano-Gosper array with element spacings of $d_{min}=\lambda$ and curve 520 represents radiation pattern slices for a Peano-Gosper array with element spacings of $d_{min}=\lambda/2$. For FIGS. 4 and 5, the angle ϕ is measured from the x-axis and the angle θ is measured from the z-axis.

Figure 6:
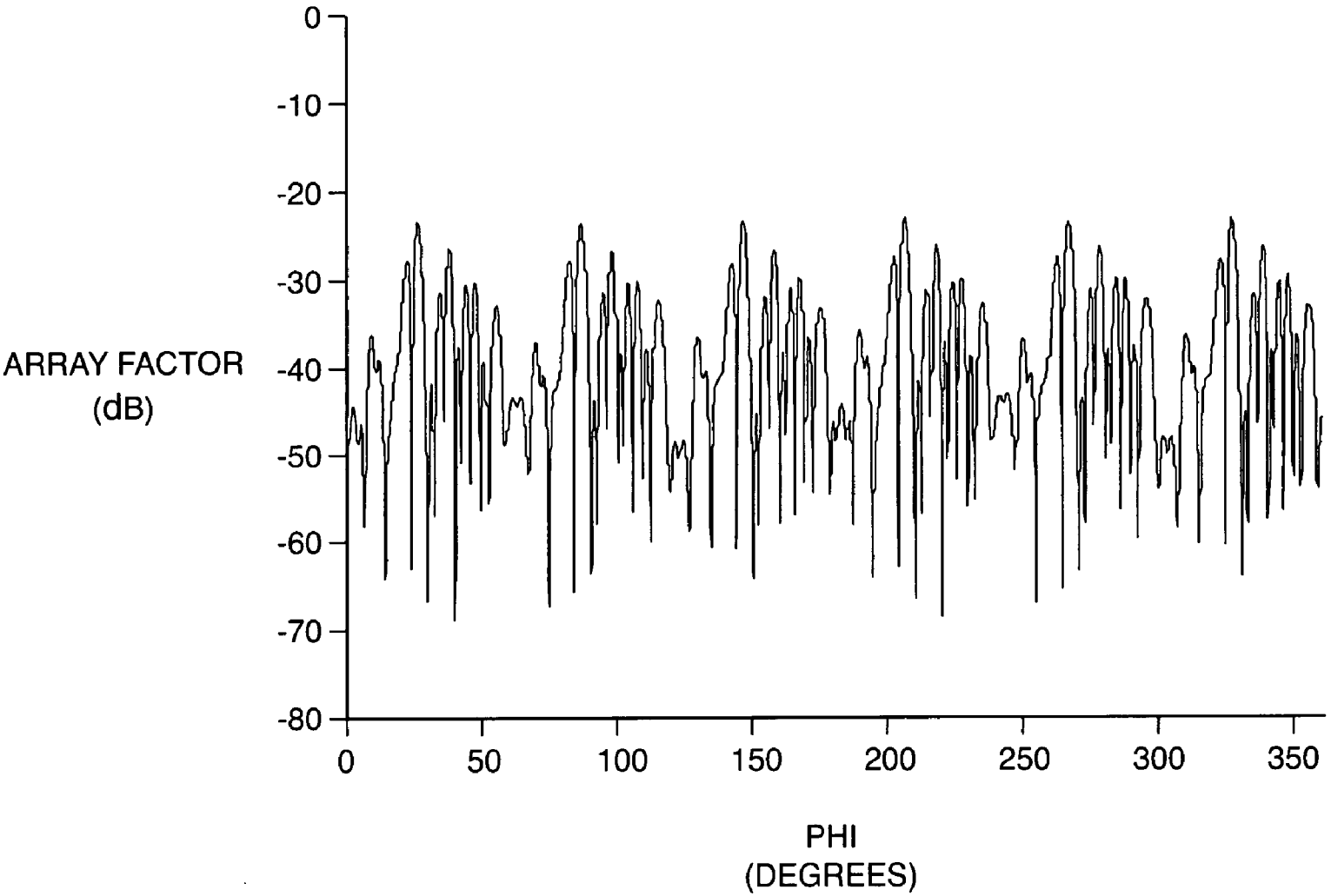
FIG. 6 illustrates a plot of the normalized stage 3 Peano-Gosper fractile array factor versus ϕ for $\theta=90°$ and $d_{min}=\lambda$.

With reference to FIG. 6, a plot of the normalized array factor versus ϕ for a stage 3 Peano-Gosper fractile array where $d_{min}=\lambda$, θ=90°, and 0°≦ϕ≦360°. FIG. 6 demonstrates the absence of grating lobes present anywhere in the azimuthal plane of the Peano-Gosper fractile array, even with antenna elements spaced one-wavelength apart. The plot shows that the highest sidelobes in the azimuthal plane are 23.85 dB down from the main beam at θ=0°. The plot shown in FIG. 6 also indicates that one of these sidelobes is located at the point corresponding to θ=90° and ϕ=26°. A plot of the normalized array factor versus θ for this Peano-Gosper factile array with ϕ=26° and $d_{min}=\lambda$ is shown in FIG. 7.

Figure 7:
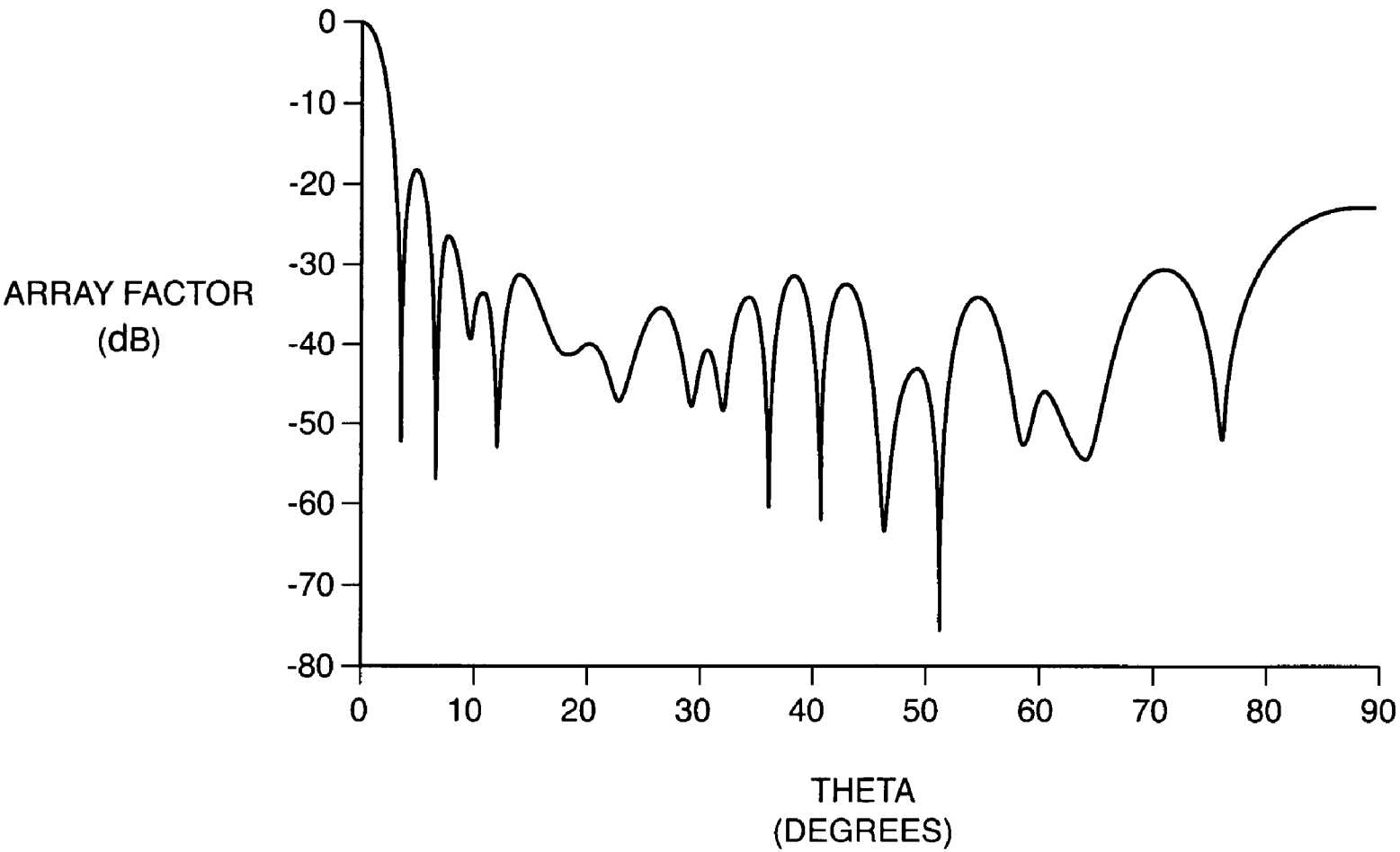
FIG. 7 illustrates a plot of the normalized stage 3 Peano-Gosper fractile array factor versus θ for $\phi=26°$ and $d_{min}=\lambda$.

The plots illustrated in FIGS. 6 and 7 demonstrate that, for Peano-Gosper fractile arrays, no grating lobes appear in the radiation pattern when the minimum element spacing is changed from a half-wavelength to at least a full-wavelength. This results from the arrangement (i.e., tiling) of parallelogram cells in the plane forming an irregular boundary contour by filling a closed Koch curve.

Figure 8:
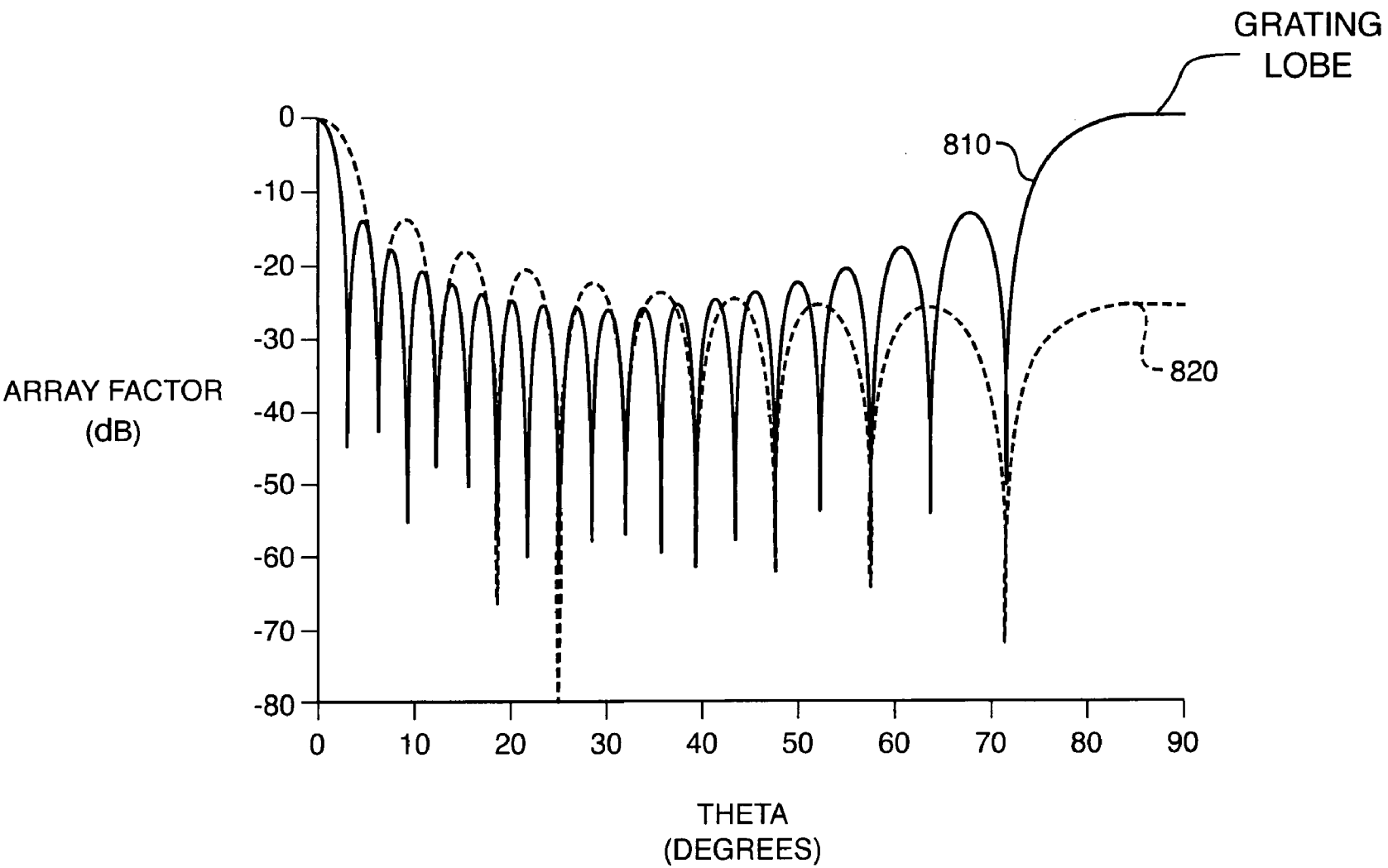
FIG. 8 illustrates a plot of the normalized array factor versus θ with $\phi=0°$ for a uniformly excited 19×19 periodic square array.

This result is in contrast to a uniformly excited periodic 19×19 square array, of comparable size to the Peano-Gosper fractile array, containing a total of 344 antenna elements. Referring to FIG. 8, plots of the normalized array factor versus θ and ϕ=0° for the 19×19 periodic square array are illustrated for antenna element spacings of $d_{min}=d=\lambda/2$, curve 820, and $d_{min}=d=\lambda$, curve 810 where the main beam orientation is $\theta_o$0° and $\phi_o$=0°. A grating lobe is clearly visible for the case in which the elements are periodically spaced one wavelength apart.

Figure 9:
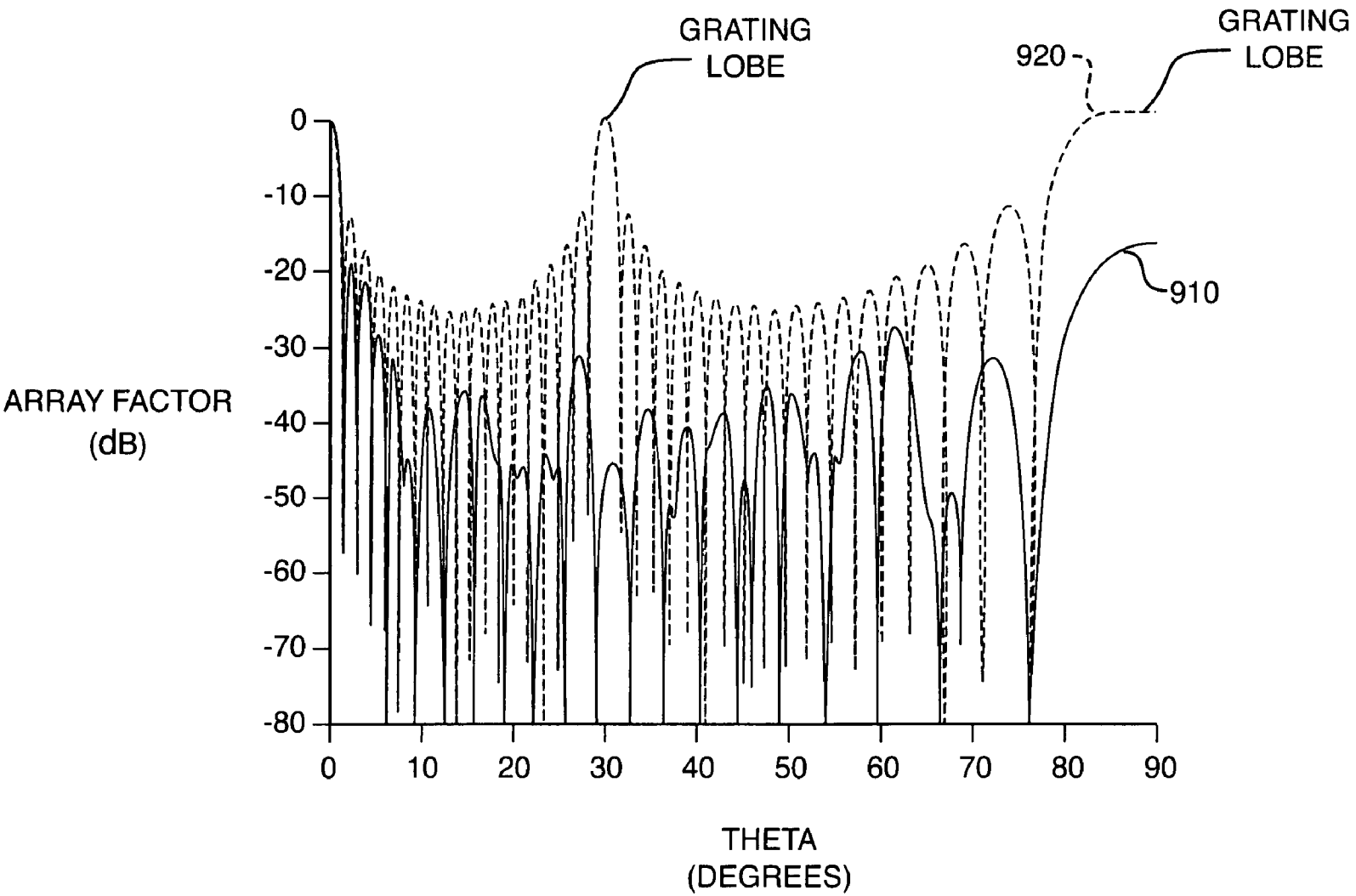
FIG. 9 illustrates plots of the normalized array factor versus θ with $\phi=0°$ and $d_{min}=2\lambda$ for a stage 3 Peano-Gosper fractile array and a 19×19 square array.

Referring to FIG. 9, a plot 910 of the Peano-Gosper fractile array factor versus θ with ϕ=0° is illustrated for the case where the minimum spacing between antenna elements is increased to two wavelengths (i.e., $d_{min}=2\lambda$). In contrast, a plot 920 of the array factor versus θ with ϕ=0° for a uniformly excited 19×19 square array with elements spaced two wavelengths apart is also illustrated. Two grating lobes are clearly identifiable in the radiation pattern of the conventional 19×19 square array.

The maximum directivity of a Peano-Gosper fractile array differs from that of a convention 19×19 square array. This value is calculated by expressing the array factor for a stage P Peano-Gosper fractile array with $N_P$ elements in an alternative form given by:

$$\begin{aligned} AF_P(\theta, \varphi) &= \sum_{n=1}^{N_P} I_n \exp(j\beta_n)\exp(jk\vec{r}_n \cdot \hat{n}) \\ &= \sum_{n=1}^{N_P} I_n \exp j[k r_n \sin\theta \cos(\varphi - \varphi_n) + \beta_n] \end{aligned} \tag{16}$$

where $I_n$ and $\beta_n$ represents the excitation current amplitude and phase of the $n^{th}$ element respectively, $\vec{r}_n$ is the horizontal position vector for the $n^{th}$ element with magnitude $r_n$ and angle $\phi_n$, and $\hat{n}$ is the unit vector in the direction of the far-field observation point. An expression for the maximum directivity of a broadside stage P Peano-Gosper fractile array, where the main bean is directed normal to the surface of the planar array, of isotropic sources may be readily obtained by setting $\beta_n=0$ in (16) and substituting the result into $$D_P = \frac{|AF_P(\theta,\varphi)|^2_{\max}}{\frac{1}{4\pi}\int_0^{2\pi}\int_0^{\pi}|AF_P(\theta,\varphi)|^2\sin\theta d\theta d\varphi} \tag{17}$$

This leads to the following expression for the maximum directivity given by:

$$D_P = \frac{\left(\sum_{n=1}^{N_P} I_n\right)^2}{\sum_{n=1}^{N_P} I_n^2 + \sum_{m=2}^{N_P}\sum_{n=1}^{m-1} I_m I_n I_{mn}} \tag{18}$$

where $$S_{mn} = \frac{1}{2\pi}\int_0^{\pi}\int_0^{2\pi}\cos(k|\vec{r}_m-\vec{r}_n|\sin\theta\cos(\varphi-\varphi_{mn}))\sin\theta d\varphi d\theta \tag{19}$$

and $\phi_{mn}$ represents the polar angle measured from the x-axis to the vector $\vec{r}_{mn}=\vec{r}_m-\vec{r}_n$.

The inner integral in (19) may be shown to have a solution of the form $$\frac{1}{2\pi}\int_0^{2\pi}\cos(k|\vec{r}_m-\vec{r}_n|\sin\theta\cos(\varphi-\varphi_{mn}))d\varphi = J_0(k|\vec{r}_m-\vec{r}_n|\sin\theta) \tag{20}$$

Substituting (20) into (19) yields $$S_{mn} = \int_0^{\pi} J_0(k|\vec{r}_m-\vec{r}_n|\sin\theta)\sin\theta d\theta \tag{21}$$

The following integral relation (22) is then introduced $$\int_0^{\frac{\pi}{2}} J_0(x\sin\theta)\sin\theta d\theta = \frac{\sin x}{x} \tag{22}$$

which may be used to show that (21) reduces to $$S_{mn} = 2\frac{\sin(k|\vec{r}_m-\vec{r}_n|)}{k|\vec{r}_m-\vec{r}_n|} \tag{23}$$

Finally, substituting (23) into (18) results in $$D_P = \frac{\left(\sum_{n=1}^{N_P} I_n\right)^2}{\left(\sum_{n=1}^{N_P} I_n^2\right) + 2\sum_{m=2}^{N_P}\sum_{n=1}^{m-1}\left(I_n I_m \frac{\sin(k|\vec{r}_n-\vec{r}_m|)}{(k|\vec{r}_n-\vec{r}_m|)}\right)} \tag{24}$$

Table 3 includes the values of maximum directivity, calculated using (24), for several Peano-Gosper fractile arrays with different minimum element spacings $d_{min}$ and stages of growth P. Table 4, furthermore, provides a comparison between the maximum directivity of a Peano-Gosper fractile array and that of a conventional uniformly excited 19×19 planar square array. These directivity comparisons are made for three different values of antenna element spacings (i.e., $d_{min}=\lambda/4$, $d_{min}=\lambda/2$, and $d_{min}=\lambda$). Where the element spacing is assumed to be $d_{min}=\lambda/4$ and $d_{min}=\lambda/2$, the maximum directivity of the Peano-Gosper fractile array and the 19×19 square array are comparable. However, when the antenna element spacing is increased to $d_{min}=\lambda$, the maximum directivity for the Peano-Gosper fractile array is about 10 dB higher

TABLE 3

| Minimum Spacing $d_{min}/\lambda$ | Stage Number P | Maximum Directivity $D_p$ (dB) |
|---|---|---|
| 0.25 | 1 | 3.58 |
| 0.25 | 2 | 12.15 |
| 0.25 | 3 | 20.67 |
| 0.5 | 1 | 9.58 |
| 0.5 | 2 | 17.90 |
| 0.5 | 3 | 26.54 |
| 1.0 | 1 | 9.52 |
| 1.0 | 2 | 21.64 |
| 1.0 | 3 | 31.25 |

than the 19×19 square array. This is because the maximum directivity for the stage 3 Peano-Gosper fractile array increases from 26.54 dB to 31.25 dB when the antenna element spacing is changed from a half-wavelength to one-wavelength respectively. In contrast, the maximum directivity for the 19×19 square array drops from 27.36 dB down to 21.27 dB. The drop in value of maximum directivity for the 19×19 square array may result from the appearance of grating lobes in the radiation pattern.

TABLE 4

| Element Spacing | Maximum Directivity (dB) | |
|---|---|---|
| $d_{min}/\lambda$ | Stage 3 Peano-Gosper Array | 19 × 19 Square Array |
| 0.25 | 20.67 | 21.42 |
| 0.5 | 26.54 | 27.36 |
| 1.0 | 31.25 | 21.27 |

Figure 10:
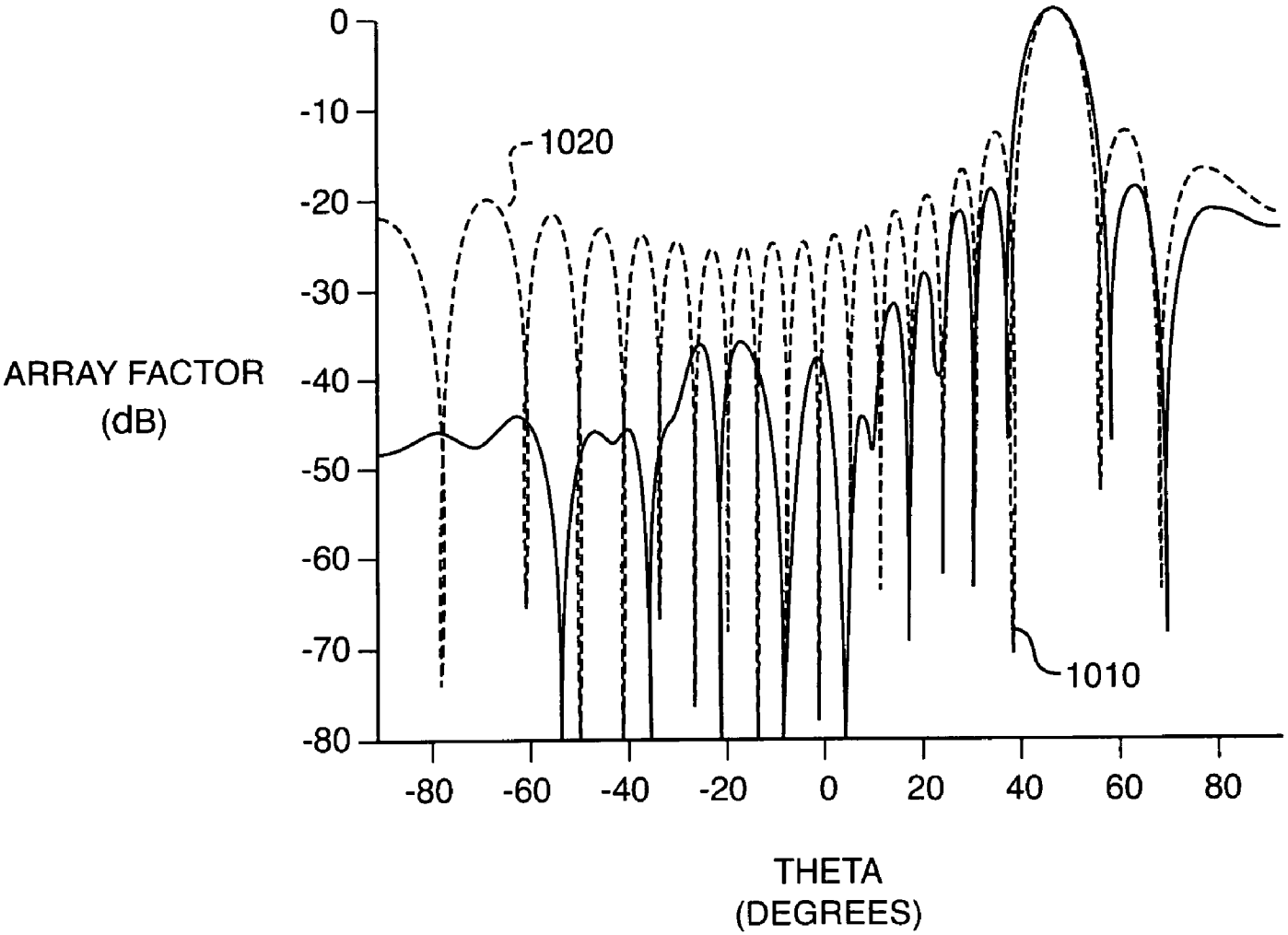
FIG. 10 illustrates plots of the normalized array factor versus θ for $\phi=0°$ with main beam steered to $\theta_o=45°$ and $\phi_o=0°$.

Referring to FIG. 10, a plot of the normalized array factor versus θ for φ=0° is illustrated where the main beam of the Peano-Gosper fractile array is steered in the direction corresponding to $\theta_o=45°$ and φ°=0°. The antenna element phases for the Peano-Gosper fractile array are chosen according to $$\beta_n=-kr_n\sin\theta_o\cos(\phi_o-\phi_n) \tag{25}$$

Curve 1010 shows the normalized array factor for a stage 3 Peano-Gosper fractile array where the minimum spacing between elements is a half-wavelength and curve 1020 shows the normalized array factor for a conventional 19×19 uniformly excited square array with half-wavelength element spacings. This comparison demonstrates that the Peano-Gosper fractile array is superior to the 19×19 square array in terms of its overall sidelobe characteristics in that more energy is radiated by the main bean rather than in undesirable directions.

Figure 11A:
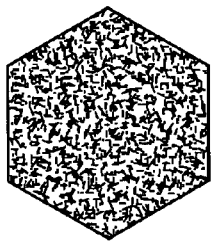
FIGS. 11A–11C illustrate the structure of the Peano-Gosper fractile array based on tiling of Gosper islands.
Figure 11B:
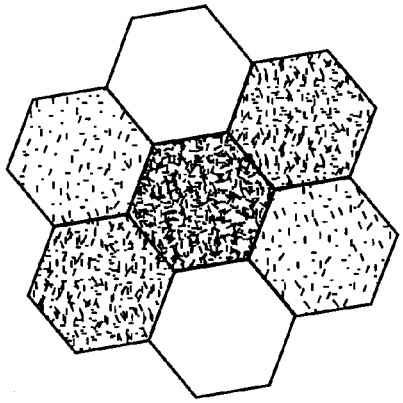
Figure 11C:
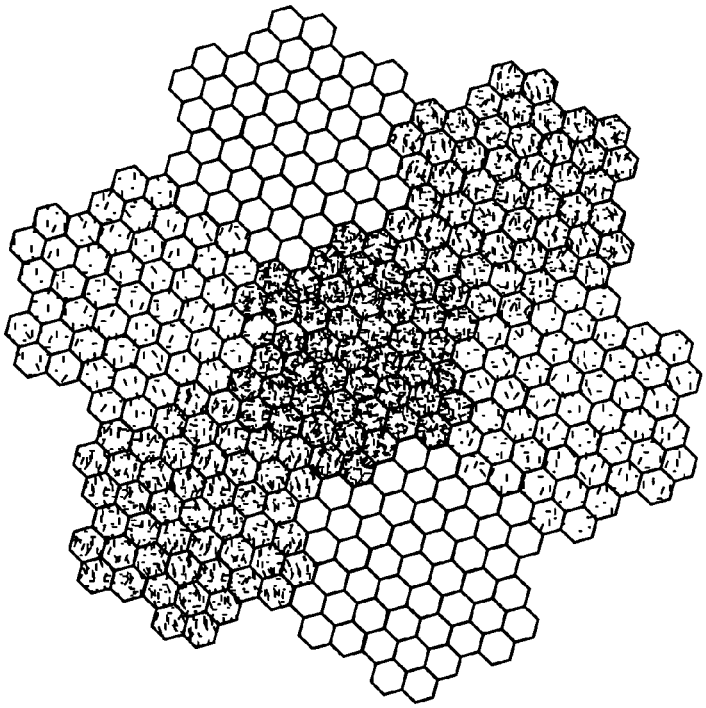

Referring to FIGS. 11A–11C, Peano-Gosper arrays are self-similar since they may be formed in an iterative fashion such that the array at stage P is composed of seven identical stage P−1 sub-arrays (i.e., they consist of arrays of arrays). For example in FIG. 11B, the stage 3 Peano-Gosper array is composed of seven stage 1 sub-arrays, FIG. 11A. Likewise, the stage 4 Peano-Gosper array, FIG. 11C, consists of seven stage 2 sub-arrays, and so on. This arrangement of sub-arrays through an iterative process lends itself to a convenient modular architecture whereby each of these sub-arrays may be designed to support simultaneous multibeam and multifrequency operation.

This invention also provides for an efficient iterative procedure for calculating the radiation patterns of these Peano-Gosper fractile arrays to arbitrary stage of growth P using the compact product representation given in equation (6). This property may be useful for applications involving array signal processing. This procedure may also be used in the development of rapid (signal processing) algorithms for smart antenna systems.

Figure 12:
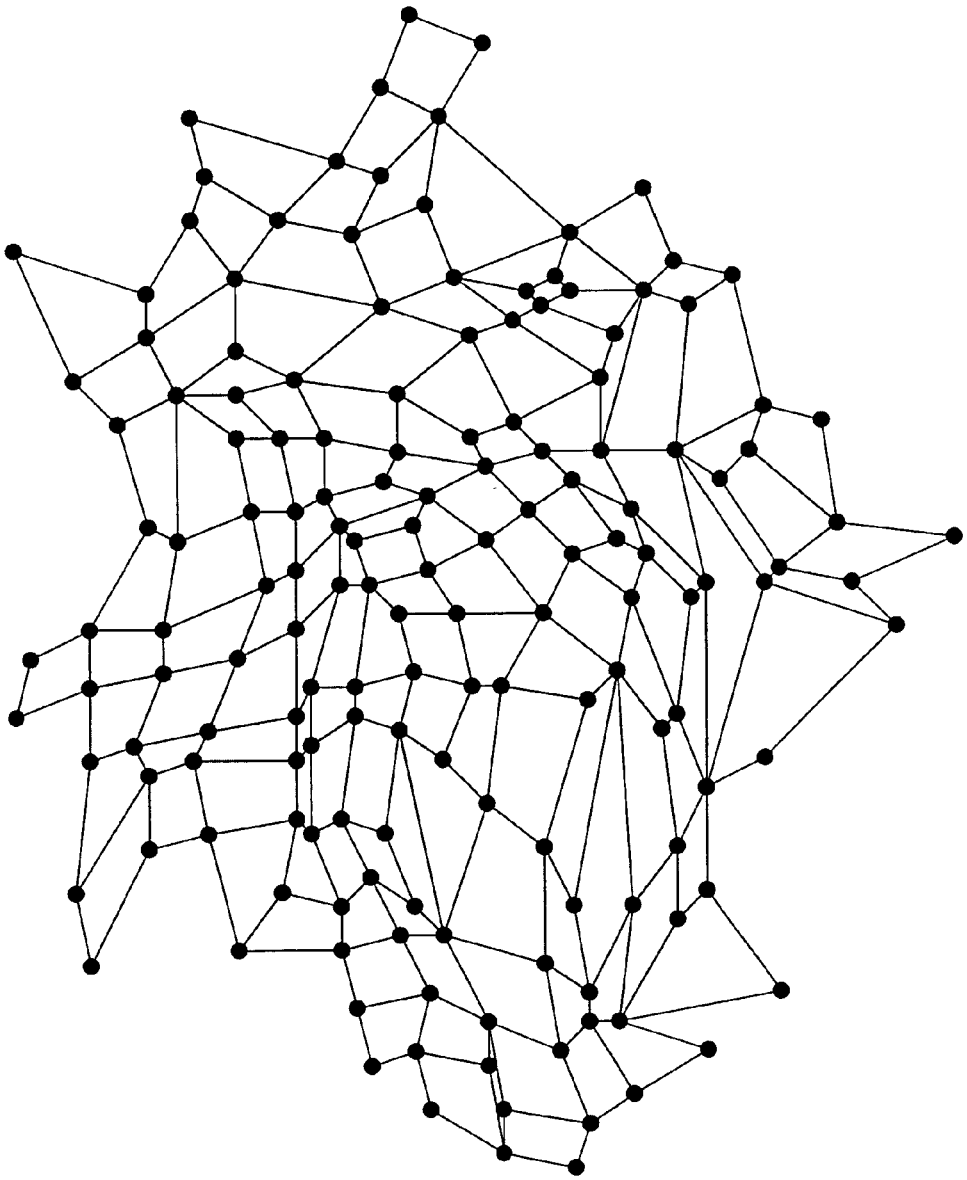
FIG. 12 illustrates a graphical representation of a plane tiled with non-uniform shaped unit cells.
Figure 13:
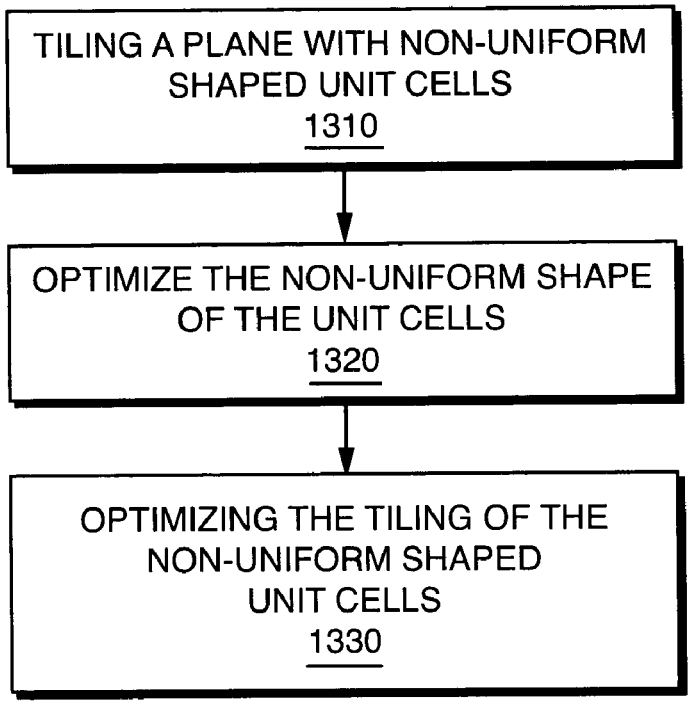
FIG. 13 is a flow chart illustrating a preferred embodiment of the invention.

With reference to FIG. 12, a graphical representation of a plane tiled with non-uniform shaped unit cells is illustrated. This invention also provides for a method of generating any planar or conformal array configuration that has an irregular boundary contour and is composed of unit cells (i.e., tiles) having different shapes. With reference to FIG. 13, a flow chart is shown illustrating a method of the present invention for generating an antenna array having improved broadband performance wherein the antenna array has an irregular boundary contour. In step 1310, a plane is tiled with a plurality of non-uniform shaped unit cells of an antenna array. In step 1320, the non-uniform shape of the unit cells are optimized. In step 1330, the tiling of said unit cells are optimized. The optimization may be performed using genetic algorithms, particle swarm optimization or any other type of optimization technique.

Figure 14:
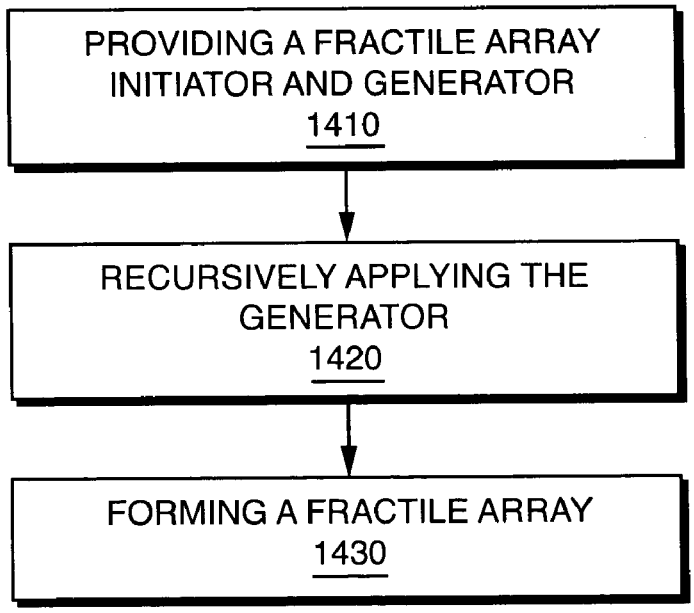
FIG. 14 is a flow chart illustrating a preferred embodiment of the invention.

With reference to FIG. 14, a flow chart is shown illustrating a method of the present invention for rapid radiation pattern formation of a fractile array. In step 1410, a factile array initiator and generator are provided. In step 1420, the generator is recursively applied to construct higher order fractile arrays. In step 1430, a fractile array is formed based on the results of the recursive procedure.

Figure 15:
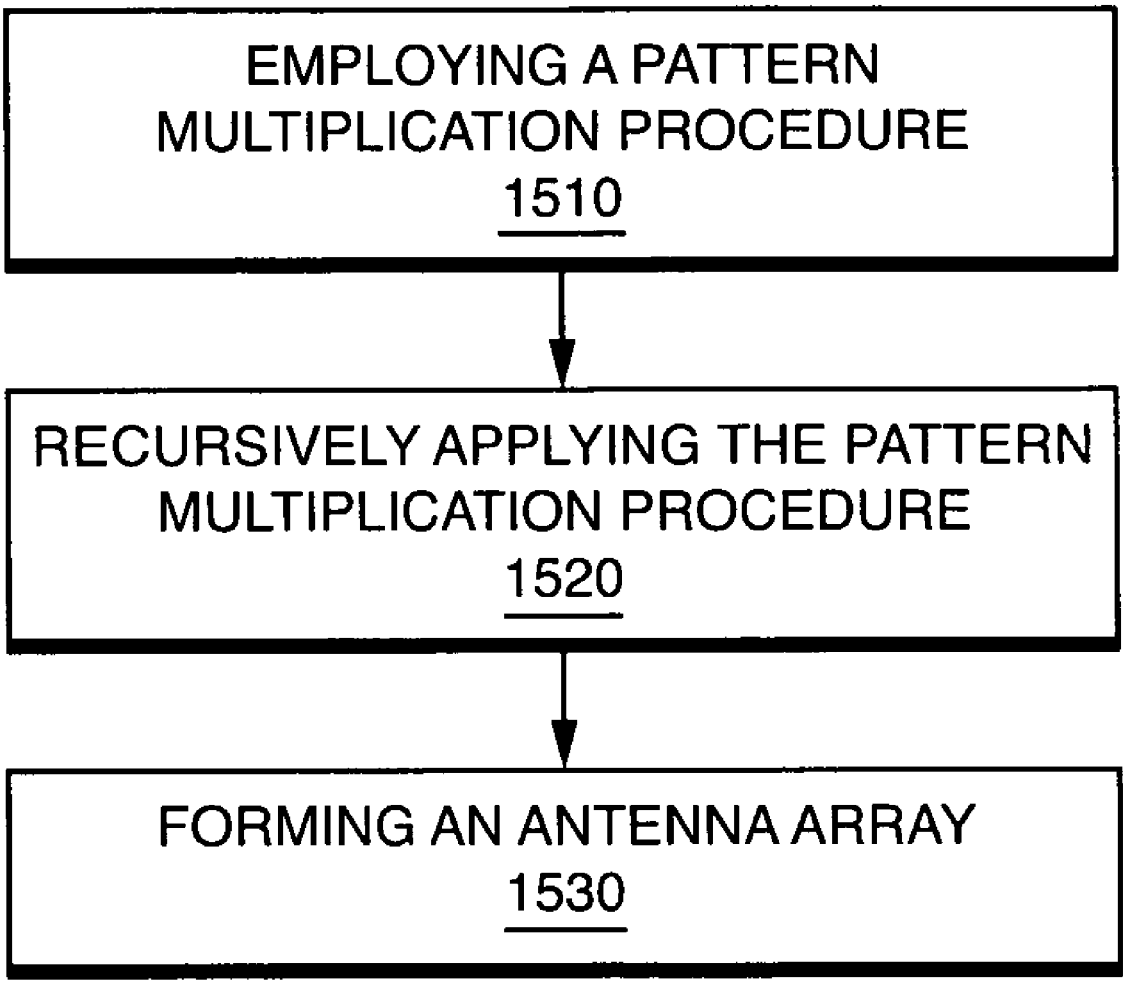
FIG. 15 is a flow chart illustrating a preferred embodiment of the invention.

With reference to FIG. 15, a flow chart is shown illustrating a method of the present invention for rapid radiation pattern formation of a Peano-Gosper fractile array. In step 1510, a pattern multiplication for fractile arrays is employed wherein a product formulation for the radiation pattern of a fractile array for a desired stage of growth is derived. In step 1520, the pattern multiplication procedure is recursively applied to construct higher order fractile arrays. In step 1530, an antenna array is formed based on the results of the recursive procedure.

The present invention may be embodied in other specific forms without departing from the spirit or essential attributes of the invention. Accordingly, reference should be made to the appended claims, rather than the foregoing specification, as indicating the scope of the invention. Although the foregoing description is directed to the preferred embodiments of the invention, it is noted that other variations and modification will be apparent to those skilled in the art, and may be made without departing from the spirit or scope of the invention.

What is claimed:

1. An antenna array, comprising a fractile array having a plurality of antenna elements uniformly distributed along a Peano-Gosper curve.

2. An antenna array comprising an array having an irregular boundary contour, wherein the irregular boundary contour comprises a plane tiled by a plurality of fractiles, said plurality of fractiles covers the plane without any gaps or overlaps.

3. A method for generating an antenna array having improved broadband performance, comprising the steps of:

tiling a plane with a plurality of non-uniform shaped unit cells of an antenna array;

optimizing the non-uniform shape of the unit cells; and optimizing the tiling of said unit cells.

4. The method of claim 3, wherein the optimizing further comprises at least one of a genetic algorithm or a particle swarm optimization.

5. A method for rapid radiation pattern formation of a fractile array wherein a fractile array comprises an array having an irregular boundary contour, wherein the irregular boundary contour comprises a plane tiled by a plurality of fractiles, said plurality of fractiles covers the plane without any gaps or overlaps, comprising the steps of:

a) employing a pattern multiplication for fractile arrays, comprising:

deriving a product formulation for the radiation pattern of a fractile array for a desired stage of growth;

b) recursively applying step (a) to construct higher order fractile arrays; and c) forming an antenna array based on the results of step (b).

6. A method for rapid radiation pattern formation of a Peano-Gosper fractile array, comprising the steps of:

a) employing a pattern multiplication for fractile arrays, comprising:

deriving a product formulation for the radiation pattern of a fractile array for a desired stage of growth;

b) recursively applying step (a) to construct higher order fractile arrays; and c) forming an antenna array based on the results of step (b).

* * * * *